US008011660B1

(12) United States Patent
Butler

(10) Patent No.: US 8,011,660 B1
(45) Date of Patent: Sep. 6, 2011

(54) LAWN GAME USING ROLLING DISKS

(76) Inventor: Matthew J. Butler, Destin, FL (US)

( * ) Notice: Subject to any disclaimer, the term of this patent is extended or adjusted under 35 U.S.C. 154(b) by 121 days.

(21) Appl. No.: 12/387,995

(22) Filed: May 12, 2009

(51) Int. Cl.
*A63B 67/00* (2006.01)

(52) U.S. Cl. ..... 273/126 R; 273/127 R; 273/127 B

(58) Field of Classification Search ..... 273/317, 273/336, 338, 348, 127 R, 127 B, 108, 126 R
See application file for complete search history.

(56) References Cited

U.S. PATENT DOCUMENTS

| | | | | | |
|---|---|---|---|---|---|
| 173,824 | A * | 2/1876 | Stevens | 273/108 |
| 712,159 | A * | 10/1902 | Voege | 273/400 |
| 1,682,279 | A * | 8/1928 | Hilpert | 273/126 R |
| 2,269,941 | A * | 1/1942 | Jones | 273/126 R |
| 2,965,376 | A * | 12/1960 | Kessler | 273/338 |
| 3,201,128 | A * | 8/1965 | Palovik | 473/572 |
| 3,403,907 | A * | 10/1968 | Keller | 273/350 |
| 4,103,894 | A * | 8/1978 | McCraw | 273/126 A |
| 4,204,682 | A * | 5/1980 | Brown | 273/401 |
| 4,339,133 | A * | 7/1982 | Warehime | 273/126 R |
| 4,392,653 | A * | 7/1983 | Blume, Sr. | 273/400 |
| 4,717,156 | A * | 1/1988 | Wright | 273/401 |
| 5,199,708 | A * | 4/1993 | Lucas | 273/126 R |
| 5,354,067 | A * | 10/1994 | Junemann | 273/400 |
| 5,419,566 | A * | 5/1995 | Byrd | 273/402 |
| 5,465,962 | A * | 11/1995 | Hiserman | 273/118 R |
| 6,015,151 | A * | 1/2000 | Carovillano et al. | 273/317 |
| 6,893,017 | B1 * | 5/2005 | Thomas et al. | 273/126 R |
| 7,014,523 | B2 * | 3/2006 | Anderson | 446/48 |
| 7,360,767 | B2 * | 4/2008 | Merccica | 273/350 |
| 2002/0033575 | A1 * | 3/2002 | Rader | 273/126 R |
| 2004/0108652 | A1 * | 6/2004 | Vaden | 273/126 R |
| 2006/0119031 | A1 * | 6/2006 | Riley et al. | 273/126 R |
| 2007/0075485 | A1 * | 4/2007 | Derman et al. | 273/119 R |
| 2009/0200742 | A1 * | 8/2009 | Maietta | 273/401 |

* cited by examiner

*Primary Examiner* — Raleigh W. Chiu
(74) *Attorney, Agent, or Firm* — Peter Loffler

(57) ABSTRACT

A lawn game uses a pair of markers toward which each player rolls a disk while standing proximate the other maker. Once all disks have been rolled, the disk closest to the marker determines which player scores points for that round. For the player scoring points, all of that player's disks that are within a certain distance from the rolled to marker score, with each disk laying flat, the number showing on the side of the disk equals the points gained for that disk, the sum of the numbers on each side of a disk remaining on its outer edge equals the points gained for that disk, and the number showing on the side of the disk laying against the rolled to marker multiplied by a multiplier equals the points gained for that disk. A rope removably attachable to the markers helps with measurements.

6 Claims, 3 Drawing Sheets

LAWN GAME USING ROLLING DISKS

BACKGROUND OF THE INVENTION

1. Field of the Invention

The present invention relates to a game that is played on a lawn or similar surface, which game uses disks that are rolled toward a target.

2. Background of the Prior Art

Spending a warm summer afternoon at the park is one of life's great treats. Enjoying the warm sun, catching a cool breeze, and tasting some fine food from the picnic basket, are just some of the riches that can be enjoyed. Another fun component of park going relies on physical activity. Whether throwing a ball, flying a kite, or simply walking, many people are desirous of doing something physical while relaxing.

What is needed is a game that people can play while at a park, the beach, or even in their own yards. Such a game must be relatively simple to set up and play, yet have a degree of challenge to the game, which level of challenge can be varied depending on the players and other factors. Ideally, the components of such a game are relatively simple in design and construction so as to be relatively inexpensive to produce so as to be readily affordable to a large segment of potential consumers of such a game. Such a game must be fairly compact so as to be readily transportable and easily storable.

SUMMARY OF THE INVENTION

The lawn game using rolling disks of the present invention is a game that can be played at a park, a beach, in the front or back yard of a house or just about anywhere where a relatively flat ground surface can be found. The lawn game using rolling disks is a game of skill that requires a modest level of physical activity. The components of the lawn game using rolling disks are relatively simple in design and construction so as to be relatively inexpensive to produce using standard manufacturing techniques. The difficulty of play of the lawn game using rolling disks can be quickly varied depending on the age and skill level of the players, the degree of challenge desired or other factors as decided by the players. The lawn game using rolling disks, when broken down, is relatively compact in dimension so as to be readily transportable and easily storable.

The lawn game using rolling disks is comprised of a pair of markers that are each placed on the ground surface in spaced apart relationship to one another. A first series of rollers is provided which rollers are each cylindrical disk members having a first pair of opposing side faces each face with a number thereon and each first disk member also having a first rounded outer edge. A second series of rollers is provided which rollers are each also cylindrical disk members having a second pair of opposing side faces each face with a number thereon and each second disk member also having a second rounded outer edge such that the numbers on the first series of disks are equivalent to the numbers on the second series of disks. Additional series of rollers may be provided for additional players or teams. The first player or first team member stands at one of the markers such that the first player rolls one of the first series of disks, on its outer surface, toward the other marker. The second player or second team member stands at the one marker such that the second player rolls one of the second series of disks toward the other marker. First and second disk rolling continues, either in alternating or sequential fashion, until all the first disks and the second disks have been rolled. Thereafter, the number of points earned by the first player or team and the second player or team (and any additional players or teams if so played) is calculated. The calculation of points by the players or teams is as follows: first, it is determined which player's disk is closest to the other marker, with all other players or teams assigned zero points for that round. For the player that has a disk that is closest to marker, it is then determined which of that player's disks are within a certain distance from the marker. For all of that player's disks that are within the certain distance, assigning a first number of points equal to the number displayed (upwardly facing number) by each disk that is within the certain distance and that is laying on its side, assigning a second number of points equal to both numbers displayed by each disk that is within the certain distance and that is resting on that disk's rounded edge, and assigning a third number of points equal to the number displayed by each disk that is laying against the other marker multiplied by a certain multiplier. Thereafter, all of the first number of points, the second number of points, and the third number of points are summed up. Each of the pair of markers is a truncated pyramid member. A rope having a plug on an end thereof is provided such that the plug is removably receivable within an opening on a top of each of the markers wherein the rope is used to determine which disk is closest to the other marker or to determine which disks are within the certain distance. An adjustable slide may be located along a length of the rope.

BRIEF DESCRIPTION OF THE DRAWINGS

Similar reference numerals refer to similar parts throughout the several views of the drawings.

DESCRIPTION OF THE PREFERRED EMBODIMENT

Figure 1:
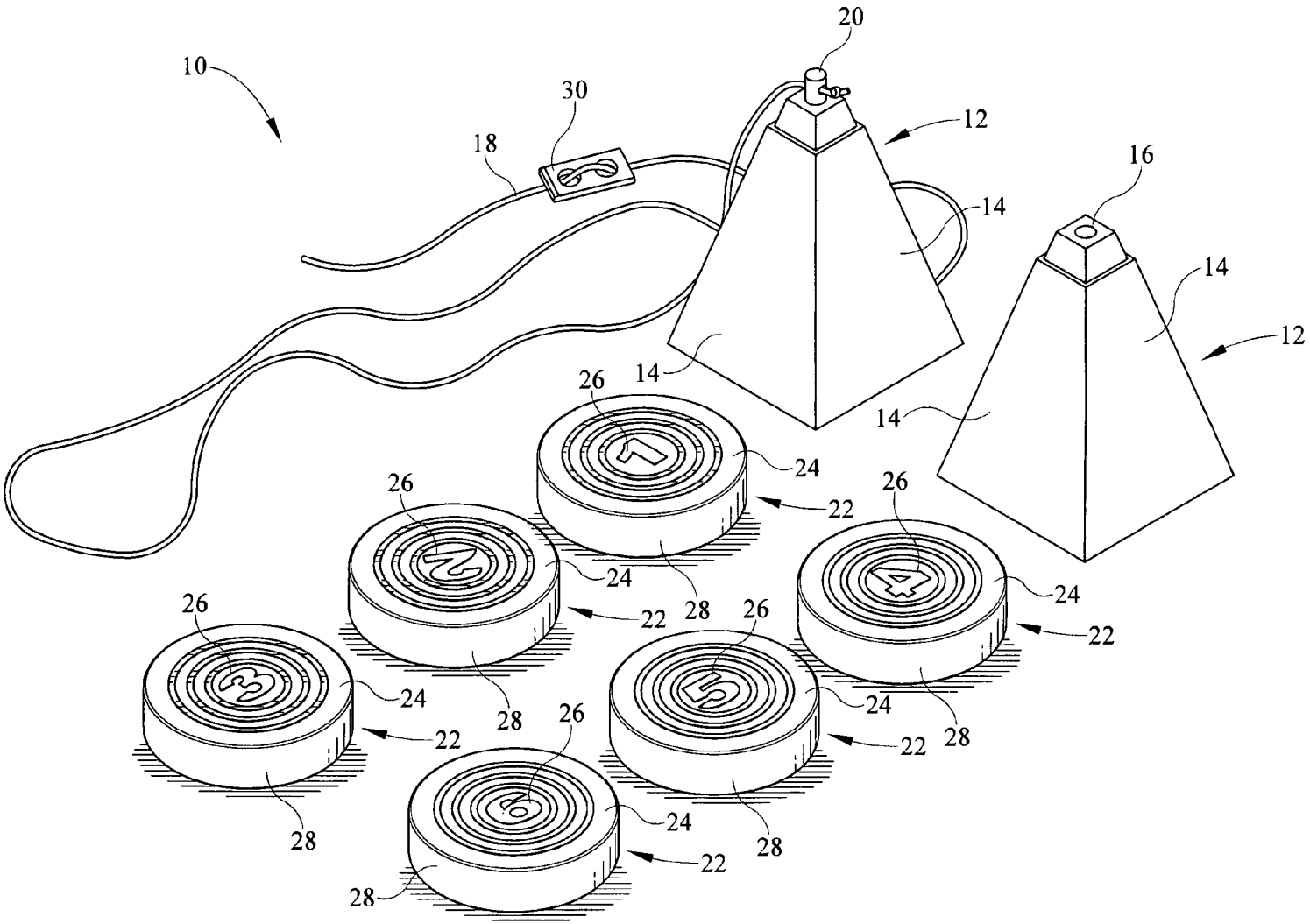
FIG. 1 is a perspective view of the components of the lawn game using rolling disks of the present invention.
Figure 2:
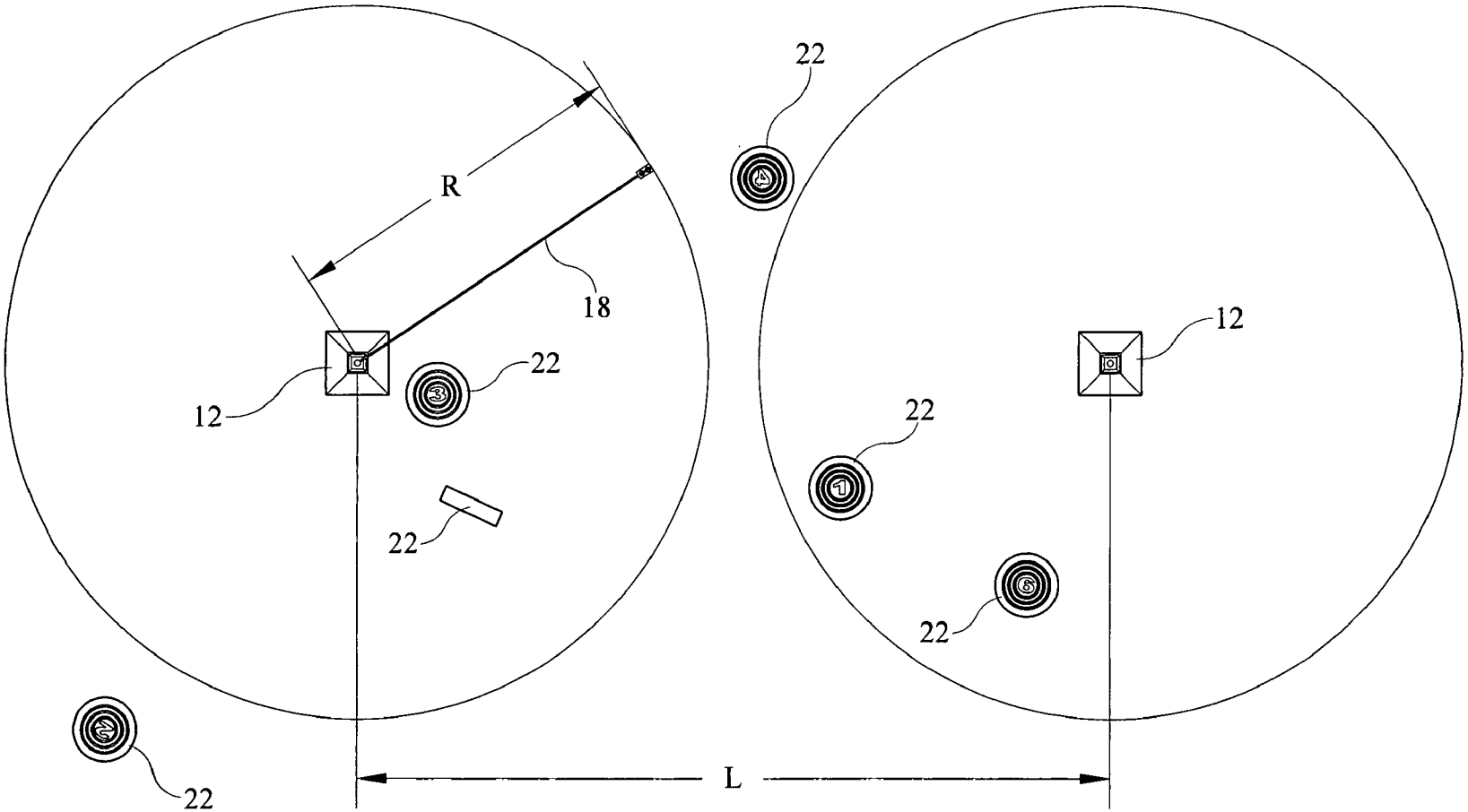
FIG. 2 is a topographical view of game play of the lawn game using rolling disks.
Figure 3:
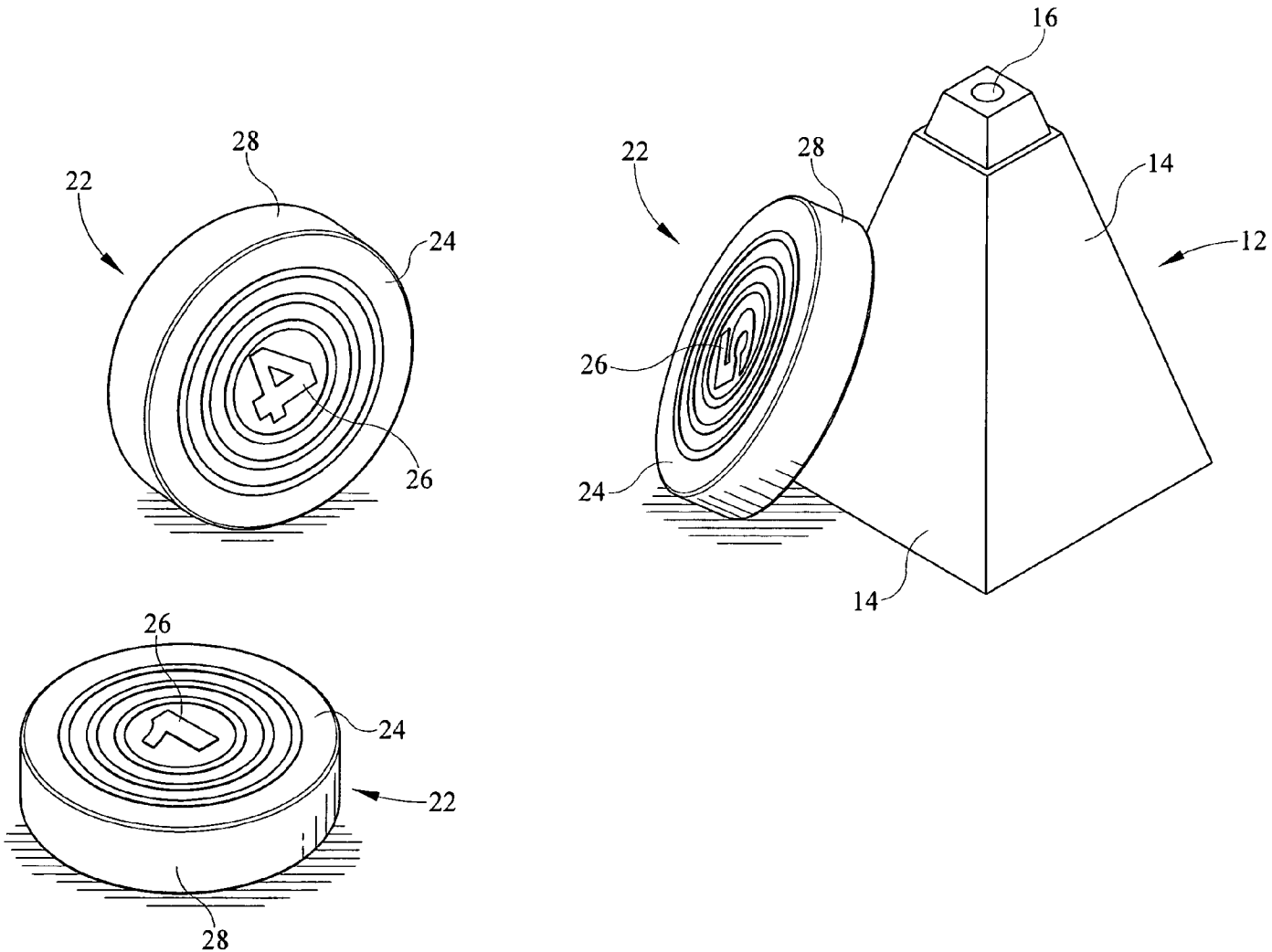
FIG. 3 is a perspective view of game play of the lawn game using rolling disks.

Referring now to the drawings, it is seen that the lawn game using rolling disks of the present invention, generally denoted by reference numeral 10, is comprised of a pair of goals or markers 12 that are each truncated pyramids that have relatively flat sides 14 and an opening 16 on the top. A rope 18 having a plug 20 on an end is provided such that the plug 20 is removably receivable within the opening 16 of the markers 12. At least two series of disks 22 are provided such that each disk has a pair of flat sides 24 that has a number 26 thereon and a rounded outer edge 28. Each series of disks 22 is distinguishable from the other series of disks 22 in appropriate fashion such as by having a different color, having different design thereon, etc, although the numbers 26 on each series of disks 22 is identical to all other series of disks 22. Each disk 22 is made from an appropriate material such as wood, a filled plastic, etc. Although each disk 22 may be made from a hollow plastic, such disks tend to be less effective in higher challenge games as more fully described below.

In order to play the lawn game using rolling disks 10 of the present invention, the two markers 12 are placed a certain distance L apart from one another, for example 25 feet part. Each player or team is given a set of disks 22 and each player, in turn, begins play at one of the markers 12. A player rolls a disk 22 on its outer edge 28 in underhand fashion similar to throwing a bowling ball, toward the other marker 12 trying to get the disk 22 as close as possible to the other marker 12. Each player or team takes turns (or each player or team proceeds sequentially) rolling their respective disks 22 until all disks 22 have been rolled. Once all disks 22 have been rolled, the player or team that has a disk 22 that is closest to the marker 12 is the only player or team that scores points for that round. In order to score points, the disk 22 must land within a certain radius R from the marker 12, for example the disk 22 must be entirely no farther than 5 feet away from the marker 12. The rope 18, which is either the length of the radius R or has an appropriate marking, such as the illustrated adjustable slide 30, a pen mark, etc., to indicate the length of the radius R, can be pulled to a given disk 22 in order to determine whether or not the disk 22 is within the required radius R. If the disk 22 is within the required radius R and the disk 22 falls flat onto one of its sides 24, then the player scores a number of points equal to the number 26 that is visible on the upwardly facing side 24 of the disk 22. If the disk 22 is within the required radius R and the disk 22 remains upright on its outer edge 28, then the player scores a number of points equal to the sum of numbers 26 on each side 24 of the disk 22. If the disk 22 is within the required radius R and the disk 22 comes to rest against the marker 12, then the player scores a number of points equal to the number 26 that is visible on the side 24 of the disk 22 that is not resting against the marker 12, multiplied by a multiplier, such as multiplied by 2. For the next round, the players now start from the marker 12 to which the players just rolled disks 22 toward and now roll disks 22 toward the other marker 12. Play continues either for a certain number of rounds or until one player or team reaches a certain point sum, such as 21.

If no disks 22 fall within the radius R, then no points are scored for that round. If two disks 22, each from an opposing player or team are equidistant from the marker 12, then either no points are awarded for that round, or each player to team is awarded points based on the above scoring formula, or the next closest disk 22 (apart from the two equidistant disks 22) is looked to determine which player or team scores points for that round.

In order to vary the challenge of the game, the distance L between the markers 12 can be varied (bringing the markers 12 closer to one another makes the game easier, while separating the markers 12 further apart makes the game more challenging) or the size of the radius R can be changed (smaller radius R makes it more difficult to score points and thus makes the game more challenging, while making the radius R larger makes scoring points easier and thus the game easier).

While the invention has been particularly shown and described with reference to an embodiment thereof, it will be appreciated by those skilled in the art that various changes in form and detail may be made without departing from the spirit and scope of the invention.

I claim:

1. A game kit for playing a game on a ground surface, the game kit comprising:

a pair of markers that are placed on the ground in spaced apart fashion each of the pair of markers being truncated pyramid members;

a first series of rollers that are cylindrical disk members having a first pair of opposing side faces each side face with a number thereon and a first rounded outer edge;

a rope having a plug on an end thereof, such that the plug is removably receivable within an opening on a top of each of the markers; and a second series of rollers that are cylindrical disk members having a second pair of opposing side faces each side face with a number thereon and a second rounded outer edge such that the numbers on the first series of disks are equivalent to the numbers on the second series of disks.

2. The game kit as in claim 1 further comprising an adjustable slide located along a length of the rope.

3. The game kit as in claim 1 wherein each of the first series of rollers is capable of gravitationally falling onto one of the first pair of opposing sides faces whenever that first roller is rolled and each of the second series of rollers is capable of gravitationally falling onto one of the second pair of opposing sides faces whenever that second roller is rolled.

4. A game kit for playing a game on a ground surface, the game kit comprising:

a pair of markers that are placed on the ground in spaced apart fashion;

a rope having a plug on an end thereof, such that the plug is removably receivable within an opening on a top of each of the markers;

a first series of rollers that are cylindrical disk members having a first pair of opposing side faces each with, a number thereon and a first rounded outer edge; and a second series of rollers that are cylindrical disk members having a second pair of opposing side faces each with a number thereon and a second rounded outer edge such that the numbers on the first series of disks are equivalent to the numbers on the second series of disks.

5. The game kit as in claim 4 further comprising an adjustable slide located along a length of the rope.

6. The game kit as in claim 4 wherein each of the first series of rollers is capable of gravitationally falling onto one of the first pair of opposing sides faces whenever that first roller is rolled and each of the second series of rollers is capable of gravitationally falling onto one of the second pair of opposing sides faces whenever that second roller is rolled.

* * * * *